US005259963A

United States Patent [19]

Wiedemann

[11] Patent Number: 5,259,963

[45] Date of Patent: Nov. 9, 1993

[54] SURFACE ACTIVE COMPOSITIONS THEIR PRODUCTION AND USE

[75] Inventor: Achim Wiedemann, Weil am Rhein, Fed. Rep. of Germany

[73] Assignee: Sandoz Ltd., Basel, Switzerland

[21] Appl. No.: 783,056

[22] Filed: Oct. 25, 1991

Related U.S. Application Data

[63] Continuation of Ser. No. 463,085, Jan. 10, 1990, abandoned.

[30] Foreign Application Priority Data

Jan. 12, 1989 [DE] Fed. Rep. of Germany ..... 3900679

[51] Int. Cl.[5] ..... D06M 13/36

[52] U.S. Cl. ..... 252/8.6; 252/8.8; 252/174.16; 252/174.21; 252/174.22

[58] Field of Search ..... 252/8.6, 8.8, 174.16, 252/174.21, 174.22

[56] References Cited

U.S. PATENT DOCUMENTS

| | | | |
|---|---|---|---|
| 3,893,937 | 7/1975 | Landauer et al. | 252/156 |
| 3,956,197 | 5/1976 | Schoenholz et al. | 252/526 |
| 4,122,032 | 10/1978 | Hollerich | 252/321 |

FOREIGN PATENT DOCUMENTS

| | | | |
|---|---|---|---|
| 7016481 | 12/1974 | Japan | 252/174.16 |
| 1082090 | 9/1967 | United Kingdom . | |
| 2196632 | 10/1987 | United Kingdom . | |

*Primary Examiner*—Olik Chaudhuri
*Assistant Examiner*—C. Everhart
*Attorney, Agent, or Firm*—Robert S. Honor; Richard E. Vila; Thomas C. Doyle

[57] ABSTRACT

Compositions containing the components (a), (b) and (c) and optionally (d) and/or (e) are eminently suitable as foam inhibiting and deaerating compositions with wetting properties and as wetting assistants for the treatment of corresponding substrates in particular for the pretreatment of textile material from aqueous medium and in the presence of typical wetting agents.

32 Claims, No Drawings

SURFACE ACTIVE COMPOSITIONS THEIR PRODUCTION AND USE

This is a continuation of application Ser. No. 07/463,085, filed Jan. 10, 1990, now abandoned.

The invention relates to novel surface active compositions, their production and their use in aqueous systems in particular as foam inhibiting, deaerating and wetting agents and as wetting assistants.

The invention thus provides water-dilutable, silicone free compositions comprising (a) a phosphoric acid triester of formula $$[R-O-(R_0O)_k]_3P=O, \quad (I)$$

in which

R signifies $C_{3-6}$-alkyl, $R_0$ signifies $C_{2-3}$-alkylene, and k signifies 0 or 1 or a mixture of such esters, (b) an iso-$C_{6-16}$-alkanol or a mixture of iso-$C_{6-16}$-alkanols and (c) a surfactant of formula $$R_1-O(\text{Alkylen-O})_m H \quad (II)$$

or $$R_1-N\begin{matrix}(\text{Alkylen}-O)_n H \\ (\text{Alkylen}-O)_p H\end{matrix}, \quad (III)$$

wherein $R_1$ signifies $C_{8-15}$-alkyl,

Alkylen signifies ethylene and optionally propylene, m signifies a number from 2 to 15, n signifies a number $\geqq 1$, p signifies zero or a positive number and $(n+p)=1$ to 11 and the molecule contains on average 1 to 10 ethylenoxy groups, or a mixture of surfactants of formula (II), of formula (III), or of formulae (II) and (III).

The radical R may be linear or branched and is propyl, butyl, pentyl or hexyl, of which the branched isomers in particular isopropyl, isobutyl, tertiary butyl, secondary butyl, isoamyl and isohexyl are of particular relevance especially when $k=0$. Isobutyl is particularly preferred as R.

$R_0$ signifies ethylene or propylene (in particular propylene-1,2). The index k signifies most preferably 0.

The isoalcohols (b) are branched $C_{6-16}$ alkanols, preferably primary isoalkanols, of which the following are particularly worth mention: 2-ethyl-butanol-1, 2-ethylhexanol-1, 2-, 3-, 4- or 5-nonanol, 2- or 5-decanol, 2- or 6-undecanol, 2-dodecanol, 2-tride-canol, 2,2,4,-trimethyl-pentanol-1 or -3, 2,2-dimethyl-heptanol-3, 3,7-dimethyl-octanol-1 and isoalkanols as obtainable by the oxo synthesis, preferably isooctanols (in particular isomeric methyl-branched alkanols with 5 to 7 carbon atoms in the main chain), isononanols (in particular 3,5,5-trimethyl-hexanol-1 and isomeric dimethyl heptanols-1), isodecanols (in particular isomeric trimethylheptanols, preponderantly 2,4,6-trimethyl-heptanol-1), isotridecanols (in particular isomeric tetramethyl-1-nonanol mixtures, preponderantly 2,4,6,8-tetramethyl-1-nonanol) and isohexadecyl alcohols (in particular isomeric pentamethyl-1-undecanol mixtures), of which the more branched alcohols, in particular as obtainable from oxosynthesis, are preferred. Of the mentioned alcohols primary isoalkanols with 8 to 13 carbon atoms are particularly preferred.

As radicals $R_1$ in formulae (II) and (III) come into consideration linear or branched alkyl radicals, advantageously linear primary $C_{8-15}$-alkyl or branched preferably primary alkyl radicals as occurring in the alcohols (b) so long as they contain 8 to 15 carbon atoms. In formula (III) the linear alkyl radicals are preferred as $R_1$. In formula (II) are preferred those radicals $R_1$ which are more branched and in particular correspond to the iso-alkanols from oxosynthesis. $R_1$ contains preferably 8 to 13 more preferably 10 to 13 carbon atoms. The indexes m, n and p are advantageously selected so that the molecule contains more than one, preferably more than two Alkylen-O groups, in particular propylenoxy groups together with ethylenoxy groups the number of ethylenoxy groups advantageously prevailing over the number of propylenoxy groups.

The compounds of formula (II) advantageously contain on average $m_1$ ethylenoxy groups and $m_2$ propylenoxy groups in total, wherein $m_1=2$ to 10 and $m_2=1$ to 5 whereby preferably $m_1>m_2$ and advantageously $(m_1+m_2)\leqq 13$.

The compounds of formula (III) advantageously contain on average $q_1$ ethylenoxy groups and $q_2$ propylenoxy groups in total, wherein $q_1=1$ to 6 and $q_2=0$ to 5 and preferably $q_1>q_2$.

Among the compounds of formulae (II) and (III), those of formula (II) are preferred.

Particularly preferred as components (c) are the compounds of the average formula $$R_1'-O(C_2H_4-O)_x(C_3H_6-O)_y(C_2H_4-O)_z H \quad (II')$$

wherein $R_1'$ signifies primary iso-$C_{8-15}$-alkyl, x signifies a number from 1 to 4, y signifies a number from 1 to 5, and z signifies a number from 1 to 9, whereby $(x+z)$ advantageously is 2 to 9 and preferably $(x+z)>y$.

In formula (II') x signifies advantageously 2 to 4, preferably 2; y signifies advantageously 1 to 4, preferably 1 to 2; z signifies advantageously 2 to 7, preferably 2 to 4.

The sum $(x+z)$ is advantageously 4 to 5. $R_1'$ contains advantageously 8 to 13, preferably 10 to 13 carbon atoms.

Per 100 parts by weight of component (a) there are employed advantageously 28 to 150, preferably 50 to 100 parts by weight of component (b).

Per 100 parts by weight of the total of components [(a)+(b)] there are employed advantageously 10 to 50, preferably 16 to 35, in particular 18 to 25 parts by weight of component (c).

The compositions of the invention advantageously further contain (d) a $C_{2-6}$-alkylene glycol or a di- or tri-($C_{2-3}$-alkylene)-glycol or a $C_{1-6}$-alkyl monoether thereof, or a mixture thereof and/or (e) water.

As component (d) come principally into consideration ethylene glycol, propylene glycol, tetra-, penta- or hexamethylene glycol, diethylene glycol, triethylene glycol, dipropylene glycol and tripropylene glycol, and their $C_{1-6}$-alkyl monoethers, wherein alkyl advantageously signifies methyl, ethyl or butyl.

Component (d) is advantageously employed in such quantities that 12 to 60, preferably 20 to 40 parts by weight of the total of components [(c)+(d)] are present per 100 parts by weight of the total of components [(a)+(b)], the weight ratio (c) : (d) being advantageously in the range of 0.15:1 to 2.0:1, preferably in the range of 0.3:1 to 1.2:1.

If desired the compositions of the invention may contain also component (e) in small quantities. The concentrated compositions of the invention advantageously contain 0 to 6% by weight, preferably 1 to 5% by weight of water (e) referred to the total weight of the composition.

The compositions of the invention are obtainable by simple admixture of the components, advantageously at temperatures in the range of 10° to 95° C., preferably 20° to 85° C., in particular 40 to 80° C. and are then ready for use.

The compositions of the invention have surface-active and interface-active properties, in particular foam inhibiting properties for foam-forming or -containing aqueous systems, wetting properties for substrates that are to be treated with water or aqueous compositions and deaerating properties for aqueous liquors and substrates that tend to the formation of air inclusions.

As foam inhibiting agents the compositions of the invention are useful in aqueous foam-forming or -containing systems and a further aspect of the invention is the process for the inhibition of foam in aqueous foam-forming or -containing systems, wherein an agent as described above is added to the system for the inhibition of undesired foam.

The term "foam inhibiting" as used herein comprises any form of countering foam, i.e. in particular prevention, quenching, destroying and hindrance of foam: i.e. the composition of the invention may be added to an aqueous system, that tends to foam formation, before any foam is formed so that a foam formation to an undesired degree may be prevented or inhibited and/or the compositions of the invention may be added to an aqueous system that already contains foam, so that the formed foam is destroyed in part or even completely or an increase of the foam is limited or even avoided. Such aqueous systems tending to foam formation or containing foam and in which a quenching and/or prevention of foam is desired are found in numerous technical fields comprising procedures in the presence of water, principally synthetic processes, purification processes, treatments and applications. Particularly worth mention are the production of starches, cellulose and sugar, the oil recovery, the flotation of colloidal ore components and the use of aqueous systems that contain foaming component as e.g. polymer dispersions, acrylic resin systems, leather treatment liquors, (e.g. for the defatting of leather), liquors for the treatment of textile material (in particular liquors containing surfactants and/or dyes or optical brighteners) and paper coating compositions.

As deaerating agents the compositions of the invention are useful in aqueous systems—in particular for the treatment of textile material—that tend to the formation of air inclusions e.g. due to turbulences in the aqueous treatment liquors or/and due to an increased air content introduced into the liquor by the structure of the substrate (e.g. terry cloth, velvet etc.).

As foam inhibiting and deaerating agents with wetting activity the compositions of the invention are useful in particular in aqueous systems, principally for textile material, preferably for the treatment of textile material in aqueous medium before or during the dyeing or optical brightening, before all in the presence of typical wetting agents as are conventionally used in such processes and systems and on which the compositions of the invention act as wetting assistants.

The compositions of the invention are foam-inhibiting and deaerating agents with wetting activity which do not need the presence of further, conventional, defoamers or deaerating agents, e.g. the presence of silicones or of other high polymers or also of paraffins, and are in particular free of such additives. Advantageously the compositions of the invention consist essentially of the above indicated components (a), (b), (c) and optionally (d) and/or (e).

The concentrated preparations consisting essentially of (a), (b), (c) and optionally (d) and/or—in small quantities—(e) are distinguished by their storage stability, i.e. no alteration of the aspect and activity of the preparations occur, even after a storage time of several months.

The compositions of the invention are dilutable with water in any proportion and may be employed directly or may be prediluted to stock solutions or formulated into reinforcing liquors optionally together with further treatment components.

With particular advantage, the compositions of the invention are employed in aqueous textile-material-treatment liquors i.e., in general, treatment liquors as may occur in any treatment step of the textile material, namely in sizing, in pretreatment, in optically brightening and/or dyeing (also printing) and in finishing of textile material.

Particularly worth mention are treatment processes, e.g. dyeing processes, other finishing processes and pretreatment processes, in which, due to the presence to the employed agents and assistants and/or by the high dynamic stress of textile material and/or treatment liquor (e.g. in dye jets) or due to the chosen treatment-conditions (e.g. HT-conditions or at a high speed of the substrates) disturbing foam and/or air-inclusions may be formed. Preferably the compositions of the invention are employed in the textile pretreatment subsequent to the sizing which is conventionally carried out in the presence of typical wetting agents (particularly wetting agents/detergents) in particular under acidic to alkaline conditions as occur in general in pretreatment, preferably in the range of from pH 4° to 20° Bé NaOH; specifically e.g. the scouring, the desizing (both oxidative and enzymatic), the acidic scouring, the alkaline pretreatment (causticizing, scour boiling, kiering) and in particular the oxidative bleach [with hypochlorite, with chlorite or with peroxyde—before all $H_2O_2$—optionally in the presence of conventional stabilizing additives (e.g. as mentioned in DE-B 22 11 578 or DE-A 38 20 160)]. The pretreatment is a process generally known in textile technique and is described e.g. in ChwalaAnger "Handbuch der Textilhilfsmittel", Verlag Chemie Weinheim, New York, 1977, and in M. Peter "Grundlagen der Textilveredlung" Fachteil T61 from "Handbuch für Textilingenieure und Textilpraktiker", 10. edition Dr. Spohr-Verlag, Wuppertal-Elberfeld und Stuttgart.

The textile material may be natural, synthetic or semi-synthetic, cellulosic fibrous material (in particular linen or cotton) optionally in admixture with polyester material being of particular relevance. The fibrous material may be in any manufacture stage as conventionally employed in the respective treatment e.g. as flock, cardings, yarns, hanks, spools, woven, knitted or tufted goods, velvet or carpets. Particularly worth mention among these are pile goods—with open or looped pile e.g. terry fabric—which as such particularly favor the formation of foam and/or air-inclusions. The treatment may take place according to any procedure suitable for the respective treatment stage e.g. from long liquor (e.g. at a liquor to goods ratio between 3:1 to 100:1—for the pretreatment mainly 3:1 to 20:1, for further treatments mainly 5:1 to 100:1) or from short liquors (e.g. by dipping or padding processes) e.g. by continuous or discontinuous processes, mainly impregnation processes in particular pad-steam, dwelling in the cold or warmth and immersion processes (in particular by processes in machines with a high speed of the goods e.g. ≧40 m/min) and at any conventional temperatures, in particular between 15° C. and HT-conditions e.g. up to 140° C.

The compositions of the invention are particularly suitable for the scouring, the oxidative or enzymatic desizing (since they are well compatible with the employed enzymes e.g. pancrease, amylase, bacterial amylase and malt diastase or amylase and are stable in the desizing liquors even under oxidative conditions), for bucking and kiering (since the compositions of the invention are stable even in the presence of highly concentrated alkali and are in particular also stable in concentrated stock solutions or reinforcing lyes) and for the oxidative bleach (since the compositions of the invention, in particular also the corresponding reinforcing liquors and bleaching liquors, are stable under the corresponding strongly alkaline conditions and also in the presence of any $H_2O_2$-stabilizing additives) in particular the cold bleach.

Of particular relevance is the compatibility with enzymes the good stability to electrolytes both under acidic and under alkaline conditions and also at elevated temperatures, the stability to hard water, the stability of stock solution and reinforcing liquors, the good air-dislocating activity which is not impaired by the various additions and treatment-conditions, and the foam-inhibiting activity in aqueous medium even in the presence of foam-generating wetting agents (as e.g. conventionally employed in the mentioned treatment and in particular pretreatment stages or as occur in the respective commercially available treatment agents and/or assistants).

The compositions of the invention are readily combinable with conventional, in particular highly active (and mostly foam-generating), typical wetting agents and wetting agent compositions (as are conventionally employed as sole wetting agents, in particular also as detergents, optionally combined with further treatment agents) so that the working with highly effective wetting agents, which, however, per se would foam to a disturbing degree, becomes possible without impairing the wetting efficiency and with avoidance of disturbing foam blankets or volumes. The above defined compositions of the invention may also act as wetting assistants and are preferably employed as additives to such typical wetting agents (in particular wetting/detergent agents as conventionally employed in the textile pretreatment) whereby the compositions of the invention even sustain the efficiency of the wetting (detergent) agents, in particular on textile material; so that with a diminished foaming and with optimum deaeration the wetting efficiency is not impaired but may even be increased. Principally these typical wetting agents are non-ionogenic or preferably at least in part anion-active. Particularly worth mention are anion-active wetting agents on the basis of oxyethylated aliphatic $C_{12-16}$-alcohols which optionally at least in part contain propylenoxy units built in the polyglycol ether chain and which are preferably anionically modified by introduction of an acid group; the average of ethylenoxy groups in the molecule being advantageously in the range of 5–50; the average number of propylenoxy units in the propylenoxy-containing molecules being advantageously in the range of 3–7, the number of ethylenoxy units being thereby preferably higher than the number of propylenoxy units; the introduced acid groups are advantageously carboxy groups (e.g. by carboxymethylation to corresponding oxyacetic acid derivatives) or preferably phosphate groups (e.g. by phosphating to corresponding phosphoric acid partial esters i.e. mono and/or diesters). Of particular relevance are the phosphoric acid partial esters described in DE 37 35 049 A (≡GB 21 96 632 A). The weight ratio [(a)+(b)+(c)] to the active substance of the typical wetting agent (as indicated above) is advantageously in the range of 4:1 to 1:5, preferably 1:1 to 1:4.

Since the formation of a disturbing foam blanket may be avoided to a great extent or even wholly according to the invention, an adjustment of the liquor level may take place without difficulties. According to the invention a disturbing foam formation in feeding equipments and a frothing over of the liquors when feeding the liquors e.g. in padding aggregates or impregnation vessels, can be avoided, whereby the liquor take-up can be increased. In long liquors (e.g. in winch-becks) a disturbing "floating" of the goods can be avoided to a great extent. The compositions of the invention are efficient under most various conditions and their efficiency does practically not diminish even after a longer treatment duration and/or at higher temperatures.

The compositions of the invention are employed in amounts effective for their desired foam inhibiting, wetting, wetting assisting and/or deaerating function, advantageously in such concentrations that the liquors contain 0.05 to 8.0, preferably 0.2 to 3.0 g of the total of the components [(a)+(b)] per liter of treatment liquor. In stock solutions and reinforcing liquors the components (a), (b) and (c) and—if present—(d) are contained in correspondingly higher concentrations.

In reinforcing liquors the treatment liquor components may be present in concentrations that amount to a concentration that is e.g. 2.5 to 6 times the concentration of the treatment liquor; in other stock solutions the concentration of the components may be e.g. in the same range as in reinforcing liquors or even higher, e.g. up to 10 times or also even up to 20 times the concentration of the treatment liquor, depending on the treatment liquor and treatment conditions.

In the following examples parts and percentages are by weight and the temperatures are in degrees Celsius; the employed isoalkanols isooctylalcohol, isononanol, isodecanol, isotridecanol and isohexadecanol are alcohols from oxo-synthesis (essentially mixtures of methyl branched isomers) and the indicated isoalkyl radicals isodecyl and isotridecyl derive from such isodecanol, respectively isotridecanol. "C.I." stands for "Colour Index".

EXAMPLE 1

The following components:
40 parts of tri-isobutyl phosphate,
15 parts of surfactant of formula (II') in which $R_1'$ signifies isodecyl, x=2, y=1 and z=2,
4 parts of demineralized water,
11 parts of ethylene glycol and
30 parts of isooctyl alcohol
are admixed at 60° C. in the indicated sequence and the mixture is stirred 30 minutes to homogeneity and allowed to cool.

EXAMPLES 2a to 2d

The procedure described in Example 1 is repeated with the difference that 30 parts of the following alcohols are employed instead of 30 parts of isooctyl alcohol:
Example 2a: isononanol
Example 2b: isodecanol
Example 2c: isotridecanol
Example 2d: isohexadecanol.

EXAMPLES 3a to 3e

The procedure described in Example 1 is repeated using 15 parts of the following surfactants instead of the 15 parts of the surfactant employed in Example 1.
Example 3a: surfactant of formula (II') in which $R_1'$ signifies isodecyl, x=2, y=2 and z=3.
Example 3b: surfactant of formula (II') in which $R_1'$ signifies isotridecyl, x=2, y=4 and z=7.
Example 3c: surfactant of formula (II') in which $R_1'$ signifies isotridecyl, x=4, y=4 and z=4.
Example 3d: surfactant of formula (III) produced by addition, in the indicated sequence, of 2 mols of ethylene oxide, 1 mol of propylene oxide and 2 mols of ethylene oxide to 1 mol od n-octylamine.
Example 3e: surfactant of formula (III) produced by addition, in the indicated sequence, of 2 mols of ethylene oxide, 4 mols of propylene oxide and 7 mols of ethylene oxide to 1 mol od n-dodecylamine.

EXAMPLES 4a and 4b

The procedure described in Example 1 is repeated with the difference that 40 parts of the following phosphates are employed in place of the 40 parts of tri-isobutyl phosphate:
Example 4a: tri(n-butyl)phosphate.
Example 4b: tri(n-butoxyethyl)phosphate.

EXAMPLES 5a to 5j

The procedure described in Example 1 is repeated with the difference that 11 parts of the following products are employed instead of the 11 parts of ethylene glycol:
Example 5a: diethylene glycol.
Example 5b: ethylene glycol monomethylether.
Example 5c: ethylene glycol monoethylether.
Example 5d: ethylene glycol mono(n-butyl)ether.
Example 5e: diethylene glycol monomethylether.
Example 5f: diethylene glycol monoethylether.
Example 5g: diethylene glycol mono(n-butyl)ether.
Example 5h: propylene glycol monomethylether.
Example 5i: dipropylene glycol monomethylether.
Example 5j: tripropylene glycol monomethylether.

Application Example A

An aqueous wetting-detergent-liquor of the following compositions is produced for enzymatic desizing:
1 g/l of nonylphenol decaethyleneglycol
3 g/l of amylase
3 g/l sodium chloride and
1 g/l of the composition of Example 1.

The pH of the liquor is adjusted to 4–6.5 with acetic acid. A cotton fabric sized with starch (or starch derivatives) is treated at a liquor-to-goods ratio of 5:1 with this liquor in the jigger for 1 hour at 70° C.

Foam formation is very slight.

Application Example B

The liquor composition according to application example A is modified insofar as in place of 1 g/l of nonylphenol-decaethylene-glycol there are employed 0.5 g/l of isotridecanol-heptaethyleneglycolether and 0.5 g/l of the oxyacetic acid derivative thereof.

A size-containing cotton fabric is impregnated at 70° C. with this liquor and expressed to 90% pick-up then rolled-up, kept dwelling for 4 hours at 25° C. and then rinsed.

Foam formation is very slight.

Application Example C

The procedure described in application example A is repeated with the difference that 1 g/l of a mixture of 1 part of the addition product of 4 moles of ethylene oxide and 5 moles of propylene oxide to 1 mole of dodecanol and 2 parts of the addition product of 6 moles of ethylene oxide to 1 mole of a technical $C_{13-15}$-alcohol mixture is employed in place of 1 g/l of nonylphenol-decaethyleneglycol ether. Practically no foam is formed during desizing.

Application Example D

An aqueous cold bleach liquor is produced which contains per liter:
0.3 g of $MgCl_2.6H_2O$
2.2 g of the addition product of 2 moles of ethylene oxide, 4 moles of propylene oxide and 7 moles of ethylene oxide to 1 mole of isotridecanol
0.8 g of sodium gluconate
8.0 ml of aqueous sodium silicate of 38° Bé
50 ml of aqueous sodium hydroxide solution of 36° Bé
60 ml of hydrogen peroxide 35% and 1 g of the compositions of Example 1.

This liquor is used for the bleaching of cotton terry fabric by immersion bleach at a velocity of the goods of 130 m/min. Foam formation is minimal and the bleaching effect is not impaired.

Application Example E

The procedure described in application example D is repeated with the difference that instead of the 2.2 g of the addition product of 2 moles of ethylene oxide, 4 moles of propylene oxide and 7 moles of ethylene oxide to 1 mole of isotridecanol, 2.2 g of the phosphoric acid partial ester of this block polymer are employed per liter of the liquor. Foam formation is minimal and the bleaching effect is not impaired.

Application Example F

An aqueous bleaching liquor is produced which contains per liter:
1 g of dodecylbenzenesulphonate, 2 g of active chlorine containing sodium hypochlorite solution and 1 g of the composition according to the example 1 and the pH of which is set to 10.5–11 with sodium hydroxide solution for the bleaching of cotton fabric.

Duration of the treatment on the jigger (liquor-to-goods ratio 5:1) 1 hour at 20°–30° C. Than the liquor is drained off and the fabric is rinsed. No disturbing foam problems arise. The foam formation is very slight.

Application Example G

A cotton fabric is padded at 20° C. with a lye-treatment liquor consisting of an aqueous sodium hydroxide solution of 19° Bé, which contains 2 g/l of phosphoric acid partial ester of isodecanoltetraethyleneglycolmonoether (wetting agent), 1 g/l of 2-ethyl-hexyl sulphate (wetting agent), and 1 g/l of the composition according to example 1.

After 10 min. dwelling the fabric is washed at 40°–50° C. in an open width washer. The fabric is well deaerated. No disturbing foam occurs.

Application Example H

A cotton fabric is padded according to a continuous process with a padding liquor of the following composition:

15 g/l of the dye C.I. Leuco Sulphur Green 2, 25 g/l of glucose, 20 g/l of NaOH 50° Bé, 1.5 g/l of octyl phosphoric acid partial ester (wetting agent) and 1 g/l of the composition according to the example 1, at 25° C. to a pick-up of 100%, and then steamed with satured steam at 102° to 104° C. for 1 min. No disturbing foam occurs. Also during the subsequent rinsing, oxidizing and soaping no disturbing foam occurs.

According to a variation of this process a mixture of 12 g of C.I. Leuco Sulphur Green 36 and 7.5 g of C.I. Lecuo Sulphur Green 2 are used in place of 15 g of C.I. Leuco Sulphur Green 2 per liter of liquor.

According to a further variation of the process according to the application example H cotton corduroy velvet is used in place of the cotton fabric. No disturbing air inclusions and no disturbing foam occur.

Analogously as the compositions according to example 1 the compositions according to each of the examples 2a to 2d, 3a to 3e, 4a, 4b and 5a to 5j are employed in application examples A, B, C, D, E, F, G and H.

I claim:

1. A water-dilutable, silicone free composition comprising (a) a phosphoric acid tri-ester of formula $$[R-O(R_O O)_k]_3P=O, \quad (I)$$

in which

R signifies $C_{3-6}$-alkyl, $R_O$ signifies $C_{2-3}$-alkylene, and k signifies 0 or 1 or a mixture of said esters, (b) an iso-$C_{6-16}$-alkanol or a mixture of iso-$C_{6-16}$-alkanols and (c) a surfactant of formula $$R_1-O(\text{Alkylen}-O)_m H \quad (II)$$

or

-continued $$R_1-N\begin{matrix}(\text{Alkylen}-O)_n H \\ (\text{Alkylen}-O)_p H\end{matrix}, \quad (III)$$

wherein $R_1$ signifies $C_{8-15}$-alkyl,

Alkylen signifies ethylene and optionally propylene, m signifies a number from 2 to 15, n signifies a number $\geqq 1$, p signifies zero or a positive number and $(n+p)=1$ to 11 and the molecule contains on average 1 to 10 ethylenoxy groups, or a mixture of surfactants of formula (II), of formula (III), or of formulae (II) and (III).

2. A composition according to claim 1 further comprising (d) a $C_{2-6}$-alkylene glycol or di- or tri-($C_{2-3}$-alkylene)-glycol or a $C_{1-6}$-alkyl monoether thereof or a mixture thereof and/or (e) water.

3. A composition according to claim 1 wherein formula (II) contains on the average $m_1$ ethylenoxy groups and $m_2$ propylenoxy groups in total, wherein $m_1=2$ to 10 and $m_2=1$ to 5, and formula (III) contains on the average $q_1$ ethylenoxy groups and $q_2$ propylenoxy groups in total, wherein $q_1=1$ to 6 and $q_2=0$ to 5.

4. A composition according to claim 1 wherein (c) is a surfactant of the average formula $$R_1'-O(C_2H_4-O)_x(C_3H_6-O)_y(C_2H_4-O)_z H \quad (II')$$

wherein $R_1'$ signifies primary iso-$C_{8-15}$-alkyl, $x=1$ to 4, $y=1$ to 5 and $z=1$ to 9.

5. A composition according to claim 1 consisting essentially (i) of components (a), (b), and (c); or (ii) of components (a), (b), (c), and (d) a $C_{2-6}$-alkylene glycol or di- or tri-($C_{2-3}$-alkylene)-glycol or a $C_{1-6}$-alkyl monoether thereof or a mixture thereof; or (iii) of components (a), (b), (c), and (e) water; or (iv) of components (a), (b), (c), (d), and (e).

6. A composition according to claim 1 wherein, in formula (I), R is branched and k is O.

7. A composition according to claim 1 wherein component (b) is a primary isoalkanol containing 8 to 13 carbon atoms.

8. A composition according to claim 1 containing 28 to 150 parts, by weight, of component (b) per 100 parts, by weight, of component (a) and 10 to 50 parts, by weight, of component (c) per 100 parts, by weight, of total combined components (a) and (b).

9. A composition according to claim 2 containing 28 to 150 parts, by weight, of component (b) per 100 parts, by weight, of component (a) and 12 to 60 parts, by weight, total combined components (c) and (d) per 100 parts, by weight, combined components (a) and (b) and wherein the weight ratio (c):(d) is in the range 0.15:1 to 2.0:1.

10. A composition according to claim 3 wherein $m_1 > m_2$, $(m_1+m_2) \leqq 13$ and $q_1 > q_2$.

11. A composition according to claim 3 wherein component (c) is a compound of formula (II).

12. A composition according to claim 3 wherein, in formula (I), R is branched and k is O and component (b) is a primary isoalkanol containing 8 to 13 carbon atoms.

13. A composition according to claim 4 wherein, in formula (II'), $R_1'$ contains 10 to 13 carbon atoms, x is 2, y is 1 to 2 and z is 2 to 4.

14. A composition according to claim 4 wherein, in formula (I), R is branched and k is O and component (b) is a primary isoalkanol containing 8 to 13 carbon atoms.

15. A composition according to claim 8 in the form of a reinforcing liquor further comprising a scouring agent, a desizing agent, a bucking and kiering agent, or an agent for the oxidative bleaching of a textile substrate.

16. A composition according to claim 10 wherein component (c) is a compound of formula (II).

17. A composition according to claim 12 containing 28 to 150 parts, by weight, of component (b) per 100 parts, by weight, of component (a) and 10 to 50 parts, by weight, of component (c) per 100 parts, by weight, of total combined components (a) and (b).

18. A composition according to claim 14 containing 28 to 150 parts, by weight, of component (b) per 100 parts, by weight, of component (a) and 10 to 50 parts, by weight, of component (c) per 100 parts, by weight, of total combined components (a) and (b).

19. A process for foam inhibition or deaeration of an aqueous system tending to the formation of foam or air inclusions or containing foam or air inclusions, which comprises adding a composition according to claim 1 to said system in an amount effective for foam inhibition or deaeration.

20. A process according to claim 19 wherein the composition is added in an amount effective for foam inhibition to an aqueous system tending to the formation of or containing foam.

21. A process according to claim 20 wherein the composition is added to an aqueous liquor for the treatment of textile material.

22. A process according to claim 21 wherein the treatment of the textile material with the aqueous liquor is carried out in the presence of a wetting agent.

23. A process according to claim 21 wherein the composition is added to an aqueous liquor for the pretreatment of textile material in the presence of a wetting agent.

24. A process according to claim 21 wherein the textile material travels at a velocity $\geqq 40$ m/min. during the treatment with the aqueous liquor.

25. A process according to claim 22 wherein the wetting agent is non-ionogenic or at least partially anion-active and the weight ratio of (a)+(b)+(c) to the active substance of the wetting agent is in the range 4:1 to 1:5.

26. A process according to claim 23 wherein the wetting agent is non-ionogenic or at least partially anion-active and the weight ratio of (a)+(b)+(c) to the active substance of the wetting agent is in the range 4:1 to 1:5.

27. A process according to claim 26 wherein the pretreatment comprises scouring, oxidative or enzymatic desizing, bucking and kiering or oxidative bleaching.

28. A process for inhibiting foam formation in an aqueous liquor for the treatment of textile material in the presence of a non-ionogenic or at least partially anion-active wetting agent which comprises adding to the aqueous liquor a foam inhibiting-effective amount of a composition according to claim 17 such that the weight ratio of (a)+(b)+(c) to the active substance of the wetting agent is in the range 4:1 to 1:5.

29. A process for inhibiting foam formation in an aqueous liquor for the treatment of textile material in the presence of a non-ionogenic or at least partially anion-active wetting agent which comprises adding to the aqueous liquor a foam inhibiting-effective amount of a composition according to claim 18 such that the weight ratio of (a)+(b)+(c) to the active substance of the wetting agent is in the range 4:1 to 1:5.

30. A composition according to claim 17 containing 50 to 100 parts, by weight, of component (b) per 100 parts, by weight, of component (a) and 16 to 35 parts, by weight, of component (c) per 100 parts, by weight, of total combined components (a) and (b).

31. A composition according to claim 18 containing 50 to 100 parts, by weight, of component (b) per 100 parts, by weight, of component (a) and 16 to 35 parts, by weight, of component (c) per 100 parts, by weight of total combined components (a) and (b) and wherein, in formula (II'), (x+z) is 2 to 9 and is greater than y.

32. A process according to claim 25 wherein component (b) is a primary isoalkanol with 8 to 13 carbon atoms.

* * * * *